United States Patent [19]

Hine

[11] 4,162,949

[45] Jul. 31, 1979

[54] REDUCTION OF STEEL CATHODE OVERPOTENTIAL

[75] Inventor: Kenneth E. Hine, St. Bruno, Canada

[73] Assignee: Canadian Industries Limited, Montreal, Canada

[21] Appl. No.: 961,629

[22] Filed: Nov. 17, 1978

[30] Foreign Application Priority Data

Nov. 23, 1977 [CA] Canada ..... 291588

[51] Int. Cl.[2] ..... C25F 1/06; C25F 3/06

[52] U.S. Cl. ..... 204/140; 204/292

[58] Field of Search ..... 204/140, 145 R, 292, 204/242

[56] References Cited

U.S. PATENT DOCUMENTS

| | | | |
|---|---|---|---|
| 3,709,803 | 1/1973 | Gulick | 204/140 |
| 4,010,086 | 3/1977 | Barrett et al. | 204/145 R |
| 4,080,278 | 3/1978 | Ravier et al. | 204/292 |

*Primary Examiner*—T. M. Tufariello

*Attorney, Agent, or Firm*—Guy Drouin

[57] ABSTRACT

The hydrogen overpotential of a steel cathode for use in the electrolysis of aqueous alkali metal solutions in diaphragm electrolytic cells is reduced by depolarization in a highly alkaline electrolyte. The reduction results in an appreciable reduction of the overall electrical energy required to effect electrolysis of said solutions.

5 Claims, 1 Drawing Figure

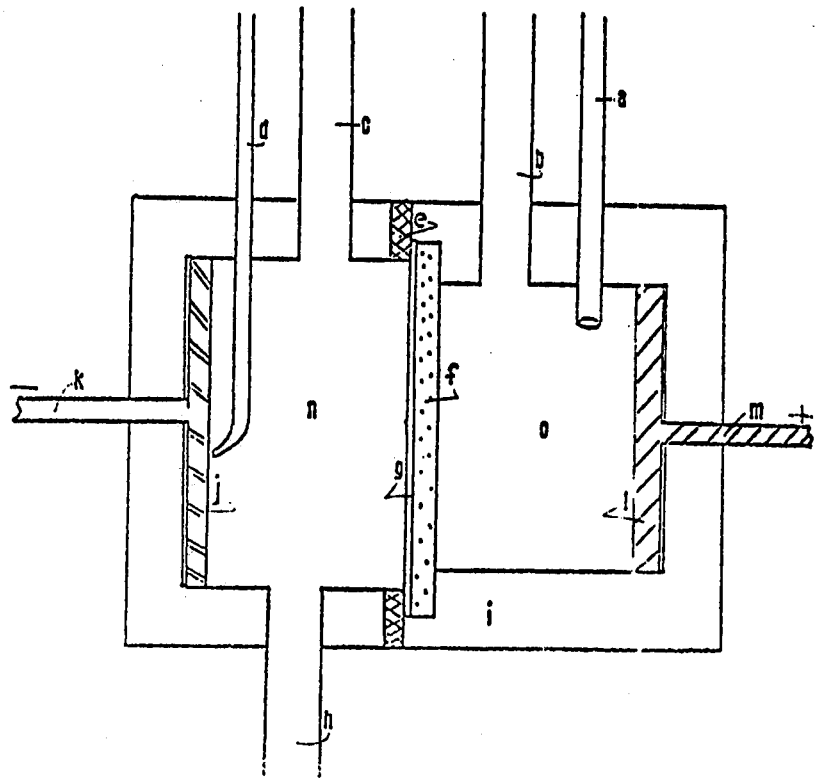
a
b
c
d
e
f
g
h
i
j
k
l
m
n
o
−
+

REDUCTION OF STEEL CATHODE OVERPOTENTIAL

This invention relates to steel cathodes for use in the electrolysis of aqueous alkali metal halide solutions in diaphragm electrolytic cells and more particularly, is concerned with a method for reducing the hydrogen overpotential at such cathodes.

The method now customarily adopted for commercial production of chlorine and caustic soda consists in the electrolysis of brine in a diaphragm cell. Such a cell is generally comprised of an anode and a cathode separated by a permeable barrier called diaphragm. The cathode is typically of perforate or foraminous mild steel and the diaphragm is in contact therewith.

The overall electrical energy required to effect electrolysis of brine in a diaphragm cell represents a very significant component of the total production costs and it has long been realized by those versed in the art that even small reductions in overall cell voltage may be commercially important. Among the factors which contribute to energy consumption, there is that known as the hydrogen overpotential at the cathode which is due to the reduction of water at the cathode to hydrogen and caustic according to the equation:

$$2H_2O+2\epsilon \rightarrow H_2+2OH^-$$

Associated with this reaction is indeed a certain energy requirement called hydrogen overpotential which is characteristic of the electrode material and is in the range of 0.37 to 0.39 volt at 2 kA/m$^2$ for mild steel.

Many attempts have been made in the past with the view to reducing hydrogen overpotential at the cathode in a chloralkali diaphragm cell. One proposal has been to coat a steel or titanium cathode substrate with a noble metal or a combination of noble metals having low overpotential properties. Other proposals comprise nickel coatings (G. Pfleidener, U.S. Pat. No. 1,818,579), porous metal coatings (F. Hine, German Offen. No. 2,527,386), rhenium and ruthenium coatings (S. D. Gokhole, U.S. Pat. Nos. 3,945,907 and 3,974,058) and various noble metal alloy coatings (J. R. Hall, U.S. Pat. No. 3,291,714 and Canadian Pat. No. 699,534). Electroplating has been the most popular method of applying these coatings to the steel or titanium substrates.

The aforementioned prior art techniques provide a more active surface for the electrochemical evolution of hydrogen than does uncoated steel and effectively afford a lower cell voltage and reduced energy cost per unit weight of chlorine produced. However, these techniques suffer from certain disadvantages which, thus far, have prevented their commercial scale application. Some coating components such as ruthenium and rhenium are extremely expensive and are not easily deposited uniformly unto structurally complicated cathodes of present-day cells. In general, the coating techniques, except perhaps for electroplating are economically unattractive. Furthermore, unless the coatings are extremely adherent to the steel substrate, there are problems of coating loss due to mechanical and chemical attack.

It is the principal object of this invention to provide a novel method for reducing the hydrogen overpotential at the steel cathode of a diaphragm electrolytic cell. Another object is to reduce the hydrogen overpotential at said steel cathode without having to resort to any coating technique. These and other objects will appear hereinafter.

The present invention provides a method for reducing the hydrogen overpotential at a steel cathode when used in a diaphragm electrolytic cell, comprising:

(a) immersing the steel cathode in an alkaline electrolyte of alkalinity ranging from pH 8 to 50% by weight NaOH in the presence of a counter electrode; and (b) polarizing the steel cathode anodically at a current density of 0.015 to 0.1 kA/m$^2$ and at a temperature of 0° C. to 75° C. for a period of 0.5 to 60 minutes.

This novel method has several advantages over conventional procedures for reducing cathode overpotential in diaphragm cells. It makes it possible, for instance, to reduce cathode overpotential by as much as 0.22 volt without the application of noble metal or any other metal coating. Electroplating baths and solutions are avoided. The technique is relatively simple, can be operated during the normal rediaphragming procedures at a plant and does not require special equipment (such as flame-spraying for example).

The chemical reactions which occur at the surface of the steel cathode during treatment in accordance with the invention have not been determined. However, a tentative explanation which is not to be considered as limiting the invention herein disclosed and claimed, is that an oxidation reaction occurs whereby some form of "active iron" is produced on the cathode surface. This "active iron" may be iron oxide, iron hydroxide or a combination thereof. It may also take the form of a reduced iron oxide, iron hydroxide or a mixture of these formed when the treated steel cathode resumes operation as a cathode in a brine cell.

The method is applicable to cathodes made of mild steel (SAE 1010). The cathode may be a steel plate but normally it will be foraminous such as steel screen, expanded steel mesh, perforated steel plate, and the like.

The alkaline electrolyte in which the steel cathode is immersed may be any strongly alkaline aqueous solutions of sodium hydroxide or potassium hydroxide or sodium hydroxide together with sodium chloride. The alkalinity of the electrolyte must be in the range of pH 8 to 50% NaOH or KOH and preferably in the range of pH 8 to 100 gram per litre NaOH. Where the electrolyte is an aqueous solution of sodium hydroxide, it may contain sodium chloride in an amount of up to 25% by weight.

The depolarizing current density may be in the range of 0.015 to 0.1 kA/m$^2$ (kiloampere per square meter) but it will preferably be in the range of 0.02 to 0.05 kA/m$^2$.

The temperature of the electrolyte during depolarizing should be 0° C. to 75° C. preferably 20° C. to 25° C., and the treatment should last for 0.5 to 60 minutes, preferably 10 to 15 minutes.

The invention is illustrated by the following examples but its scope is not limited to the embodiment shown therein.

EXAMPLES 1 to 19

In each of the Examples shown in the Table appearing hereinbelow, except Example 1 which is provided for comparison purposes, a test specimen fashioned from mild steel was washed with water, immersed briefly in dilute acid, washed again with water and then immersed in a bath containing the depolarizing electrolyte solution. The electrical connections from the power source were made such that the lead from the positive terminal was connected to the steel specimen and the negative terminal to the counter electrode which was either steel or platinum but could have been of any electrically conductive metal not attacked by the electrolyte and the products of electrolysis. The current was then switched on for a period of 0.5 to 60 minutes and then switched off. The resulting steel cathode specimens and the untreated steel cathode of Example 1 were then each installed in a model brine cell and electrolysis of brine was started.

The model cell used to carry out the brine electrolysis was a model of a chloralkali diaphragm cell suitably modified to permit the necessary measurements. Reference is made to the accompanying drawing in which the single FIGURE illustrates this model cell. For each electrolysis test, a brine solution containing 310 gram per liter (gpl) of sodium chloride was fed by gravity to the anode compartment (o) of the cell (i) by brine inlet (a). By maintaining a suitable head of brine, the latter was allowed to flow through an asbestos diaphragm (f) into cathode compartment (n) and out of the cell through outlet (h). The asbestos diaphragm was mounted in the cell by means of a porous disc (g) and a gasket (e) both of "Teflon" (registered trademark for polytetrafluoroethylene). Application of a d.c. current across the electrodes by means of connectors (m) and (k) produced chlorine at anode (l) and hydrogen and caustic at cathode (j). The gases chlorine and hydrogen escaped through respective outlets (b) and (c) and the cell liquor from cathode compartment (n) was collected at (h) for analysis. The anode (l) was a disc of titanium mesh coated with noble metal oxides. The cathode was a disc of SAE 1010 mild steel. The cathode overpotential was measured with respect to a saturated calomel electrode using a glass or "Teflon"-coated glass Luggin capillary (d) by conventional techniques. Cathode overpotential could be measured to ±0.005 volt. In most of the Examples, a gradual rise in overpotential was observed during the course of the brine electrolysis.

The conditions of treatment according to the invention, the conditions of brine electrolysis and the results obtained in each of the Examples are summarized in the following Table. The range of cathode overpotentials appearing in the Table represents initial value at the start of the brine electrolysis and final value recorded just before the termination of each run. For instance in Example 1, the overpotential after one week had risen from 0.37 to 0.39 volt. The catholyte temperature was controlled to within 1° C. and the data shown in the Table represent the extremes measured during each run.

TABLE

| | | Polarization conditions used to treat cathode prior to brine electrolysis | | | | Electrolysis of brine containing 310 gpl of sodium chloride in diaphragm cell | | | |
|---|---|---|---|---|---|---|---|---|---|
| Run No. | Cathode sub-strate | Electrolyte aqueous solution | Current density kA/m² | Electro-lyte Temp. °C. | Treat-ment time min. | Cathode overpotential at 2.0 kA/m² volts | Total electro-lysis time days | Catholyte temperature °C. | Cell liquor strength (gpl NaOH) |
| 1 | Mild steel | — | — | — | — | 0.37–0.39 | 7 | 70–75 | 80–140 |
| 2 | " | 100 gpl NaOH 100 gpl NaCl | 0.06 | 22 | 2.2 | 0.15–0.21 | 126 | 70–72 | 100 |
| 3 | " | 20% NaOH | 0.014 | 22 | 18 | 0.20–0.23 | 83 | 70–72 | 100 |
| 4 | " | 10% KOH | 0.03 | 50 | 11.3 | 0.21–0.22 | 1 | 70 | 100 |
| 5 | " | 100 gpl NaOH 100 gpl NaCl | 0.03 | 22 | 6.9 | 0.25 | 2 | 70 | 100 |
| 6 | " | 100 gpl NaOH 100 gpl NaCl | 0.03 | 50 | 24 | 0.26–0.35 | 27 | 70–75 | 100–130 |
| 7 | " | 115 gpl NaOH 150 gpl NaCl | 0.03 | 75 | 3 | 0.30–0.38 | 21 | 70–75 | 110–120 |
| 8 | " | 10% NaOH | 0.03 | 50 | 7.8 | 0.28–0.33 | 6 | 70–75 | 100–120 |
| 9 | " | 10% NaCl pH 12 with NaOH | 0.04 | 22 | 15 | 0.23–0.24 | 7 | 75 | 100 |
| 10 | " | " | 0.04 | 22 | 15 | 0.17–0.18 | 13 | 74 | 100 |
| 11 | " | " | 0.04 | 22 | 10 | 0.18 | 12 | 74 | 100 |
| 12 | " | " | 0.04 | 22 | 60 | 0.19–0.21 | 8 | 71–73 | 100 |
| 13 | " | 25% NaCl pH 12 with NaOH | 0.04 | 22 | 15 | 0.25 | 10 | 70–73 | 100 |
| 14 | " | 10% NaCl pH 12 with NaOH | 0.04 | 0 | 16 | 0.24–0.26 | 15 | 68–73 | 100 |
| 15 | " | 50% NaOH | 0.02 | 22 | 16.6 | 0.32 | 12 | 72–74 | 100 |
| 16 | " | 10% NaCl pH 12 with NaOH | 0.1 | 22 | 15 | 0.27–0.30 | 2.5 | 71–72 | 100 |
| 17 | " | 25% NaCl pH 8 with NaOH | 0.05 | 22 | 30 | 0.21–0.23 | 2 | 70–71 | 100 |
| 18 | " | 10% NaCl pH 12 with NaOH | 0.04 | 22 | 15 | 0.28 | 45 | 75–80 | 125 |
| 19 | " | 25% NaCl pH 8 with NaOH | 0.05 | 22 | 30 | 0.28 | 9 | 75–80 | 140–145 |

What we claim is:

1. A method for reducing the hydrogen overpotential at the steel cathode of a cell for the electrolysis of brine comprising:

(a) immersing the steel cathode in an alkaline electrolyte of alkalinity ranging from pH 8 to 50% by weight sodium hydroxide in the presence of a counter electrode; and (b) polarizing the steel cathode anodically at a current density of 0.015 to 0.1 kiloampere per square meter and at a temperature of 0° C. to 75° C. for a period of 0.5 to 60 minutes.

2. A method as claimed in claim 1 wherein the alkaline electrolyte is an aqueous solution of potassium hydroxide or sodium hydroxide.

3. A method as claimed in claim 2 wherein the alkaline electrolyte is an aqueous solution of sodium hydroxide and contains up to 25% by weight sodium chloride.

4. A method as claimed in claim 1, 2 or 3 wherein the current density is in the range of 0.02 to 0.05 kiloampere per square meter.

5. A method as claimed in claim 1, 2 or 3 wherein the temperature ranges from 20° C. to 25° C. and the period of treatment is from 10 to 15 minutes.

* * * * *